United States Patent [19]

Tate

[11] Patent Number: 4,792,104

[45] Date of Patent: Dec. 20, 1988

[54] APPARATUS FOR FORMING YARN TRANSFER TAILS

[75] Inventor: John E. Tate, Greensboro, N.C.

[73] Assignee: Southridge Corporation, Greensboro, N.C.

[21] Appl. No.: 47,665

[22] Filed: May 7, 1987

[51] Int. Cl.[4] ..... B65H 54/02

[52] U.S. Cl. ..... 242/18 PW; 242/35.5 R

[58] Field of Search ..... 242/18 PW, 18 A, 25 A, 242/35.5 R

[56] References Cited

U.S. PATENT DOCUMENTS

| | | | |
|---|---|---|---|
| 3,581,687 | 6/1971 | Meier et al. | 242/20 X |
| 3,814,339 | 6/1974 | Hudson | 242/18 PW |
| 3,814,341 | 6/1974 | Dickson, III et al. | 242/18 PW X |
| 3,880,371 | 4/1975 | Landenberger et al. | 242/35.5 R |
| 3,982,707 | 9/1976 | Saleeby | 242/18 PW |
| 4,008,859 | 2/1977 | List et al. | 242/18 PW X |
| 4,103,835 | 8/1978 | List | 242/18 PW X |
| 4,367,849 | 1/1983 | Irby | 242/18 PW |

FOREIGN PATENT DOCUMENTS

| | | | |
|---|---|---|---|
| 958394 | 11/1974 | Canada | 242/18 PW |
| 2354472 | 6/1975 | Fed. Rep. of Germany | 242/18 PW |

*Primary Examiner*—Stanley N. Gilreath

*Attorney, Agent, or Firm*—Richard E. Jenkins

[57] ABSTRACT

An apparatus and method are described for forming transfer tails on yarn packages being wound in abutting relationship on a textile winding machine. The system utilizes a transfer tail forming means including a fixed yarn guide element defining a yarn guide surface therein with diverging sides extending generally outwardly and a movable yarn guide element cooperating therewith and adapted to move from a rearward position behind the yarn guide surface to a forward position wherein the front portion thereof extends beyond the yarn guide surface.

2 Claims, 4 Drawing Sheets

APPARATUS FOR FORMING YARN TRANSFER TAILS

DESCRIPTION

1. Technical Field

This invention relates to mechanisms for forming yarn transfer tails on high-speed textile winding equipment. More particularly, the present invention relates to an improved apparatus and method for forming yarn transfer tails on winders of the type utilizing a two cop take-up with the yarn packages being formed on tubes held in abutting relationship.

2. Background Art

A number of devices are used in the textile industry to form yarn transfer tails on two cop take-up winders such as those manufactured by Leesona Corporation. These winders wind two abutting yarn packages simultaneously and, preferably, form a free end or yarn transfer tail on each package. This allows the user of the completed yarn package in subsequent operations to tie the yarn tail of one package to the lead end of another package in order to provide for uninterrupted processing of the yarn in textile operations such as beaming or quilling.

In order to facilitate the formation of a yarn transfer tail on a yarn package, a number of different devices have been developed and utilized in the textile industry. One device, the transfer tail mechanism for high-speed winders disclosed in U. S. Pat. No. 3,814,339, comprises a pivotable yarn guide bar which releases each of two yarn strands from a slot in a fixed guide into its respective reciprocating transverse guide and, in the transition, a yarn transfer tail is formed for each of two abutting yarn packages being wound. However, this apparatus has been found to be unduly complicated and slow in operation.

In an effort to overcome the shortcomings of the aforementioned device, the transfer mechanism for forming yarn transfer tails disclosed in U.S. Pat. No. 4,367,849 was developed. This apparatus utilizes a hydraulic or pneumatically actuated, shaped rod to engage the yarn strands forming the bunch between abutting ends of the yarn packages and to release the yarn strands into the paths of the reciprocating transverse guides. This device replaces the electromagnetic actuation means of the earlier described device with a hydraulic or pneumatically actuated device which is less complex in operation and has fewer mechanical steps in its use than the apparatus disclosed in U.S. Pat. No. 3,814,339. This device, however, does require individual hydraulic or pneumatically actuated piston means for each two cop take-up and is still relatively complex in construction and use.

Applicant also understands that a yarn transfer tail forming mechanism is utilized on some two cop take-up winding machines which comprises a lower fixed yarn guide defining an outwardly open yarn guide surface with a rectangular shape. A V-shaped or spade element is provided in movable relationship on top of the fixed guide in order to pivot from a first position behind the rectangular yarn guide surface to a second position forwardly thereof. Although it is intended that the point of the device will separate two yarn strands being wound as transfer tails between abutting ends of two winding packages and then force each outwardly into the pathway of a corresponding reciprocating transverse guide, this particular device has been found to be relatively unreliable in operation. The shortcomings of the transfer tail forming device appear to relate in part to the parallel outwardly extending sides of the yarn guide surface of the bottom fixed yarn guide which tend to cause too large a yarn bunch to be wound between the abutting yarn tubes and the creation of unsatisfactorily short yarn transfer tails. This is because the yarn strands are being wound between the tubes during the entire time that they are retained in the yarn guide surface and form transfer tails only during the short time period between release from the guide surface by the spade element until each is engaged by a reciprocating transverse guide.

All of the devices described hereinabove tend to form short transfer tails since when the yarn strands are released from the initial fixed yarn strand guide they quickly spring laterally outwardly into engagement with the reciprocating guide means. The short time period between release of the yarn strands and their engagement with the reciprocating guide means allows for only a short transfer tail to be formed having a length of about one spiral wrap or less, as can be seen with reference to the drawings in both U.S. Pat. Nos. 4,367,849 and 3,814,339. In contrast, the applicant's inventive apparatus and method allows the yarn strands to be wound in spiral wraps around their respective yarn tubes prior to release and as they are being forced from the yarn strand guide. The result is control by the operator over the yarn strands as the yarn strands are forming transfer tails. This control is not to be found in previous transfer tail forming mechanisms.

Thus, the prior art transfer tail forming mechanisms known to applicant all suffer shortcomings in that the mechanism is unduly complex and does not reliably function to form yarn transfer tails of a controllable and satisfactory length.

The apparatus of the present invention is designed to overcome the shortcomings of previous yarn transfer tail forming mechanisms.

DISCLOSURE OF THE INVENTION

In accordance with the present invention, applicant provides a novel and unique system for the reliable winding of precision textile packages with yarn transfer tails and eliminates many of the shortcomings of prior art devices. The present invention comprises a transfer tail forming means positioned adjacent to the abutting ends of the tubes on a two cop take-up winding machine such as those manufactured by Leesona Corporation. Typically, on this type of dual package winding machine, two strands of yarn are initially secured between the abutting ends of the two rotating winding tubes on which the cops or packages are to be wound after the yarn strands have been acted upon and released by the conventional transfer tail forming mechanism. After several turns of yarn strands have been wound around the slot at the abutting end of the two yarn packages to form the yarn strand bunch which serves to hold the transfer tails in place, the conventional transfer tail mechanism serves to force the two yarn strands therefrom and into cooperative engagement with the reciprocating transverse guides which then serve to wind the main body of yarn onto each tube. The transfer tails are normally formed during the short period of time between release of the yarn strands until their engagement by the reciprocating transverse guides.

The improved apparatus of the present invention includes a means for rotatably mounting two abutting winding tubes and means for rotation of the winding tubes. Means are provided for feeding one or more yarn strands to each of the winding tubes, and reciprocating guide means are associated with the mounting means for guiding yarn strands onto the winding tubes in order to build a desired yarn package. The novel transfer tail forming mechanism of the instant invention is positioned adjacent the reciprocating guide means and comprises a fixed yarn guide element for initially engaging the yarn strands. The fixed yarn guide element includes a yarn guide surface which has diverging sides extending outwardly from the reciprocating guide means and defining an opening between the outermost ends for receiving yarn strands which are to be initially secured in the slot between the abutting ends of the winding tubes in order to form a yarn transfer tail for each package. A movable yarn guide element is cooperatively associated with the fixed yarn guide element in order that it may move from a first position therebehind to a second position wherein as least the front portion of the movable yarn guide element extends beyond the yarn guide surface.

The transfer tail forming means is adapted such that during movement from the first to the second position the transfer tails are formed by the movable yarn guide element urging the strands laterally outwardly along each diverging side of the yarn guide surface of the fixed yarn guide element until they are released into the path of the reciprocating guide means. Preferably, the fixed yarn guide element substantially defines a W shape wherein the medial portion generally defines the yarn guide surface, and the movable yarn guide element operatively associated therewith defines a spade-like or V shape wherein the point thereof is directed outwardly substantially along the midline of the yarn guide surface.

The transfer tail forming means of the instant invention may be manually actuated or automatically actuated. Automatic actuation could be achieved with a timer and dash pot assembly or in any other suitable fashion.

It is therefore the object of this invention to provide an improved apparatus for forming yarn transfer tails on a two cop take-up textile winding machine.

Another object of the present invention is to provide a simple and inexpensive device for reliably forming transfer tails of a satisfactory length on a textile winding machine of the type wherein two abutting tubes are wound simultaneously.

Still another object of the instant invention is to provide a yarn transfer tail mechanism which provides for the controlled winding of transfer tails, preferably a multiple wrap spiral, in the space on abutting tubes between the yarn bunch and the package build area.

DESCRIPTION OF THE DRAWINGS

Some of the objects of the invention having been stated, other objects will become evident as the description proceeds, when taken in connection with the accompanying drawings in which.

BEST MODE FOR CARRYING OUT THE INVENTION

Figure 1:
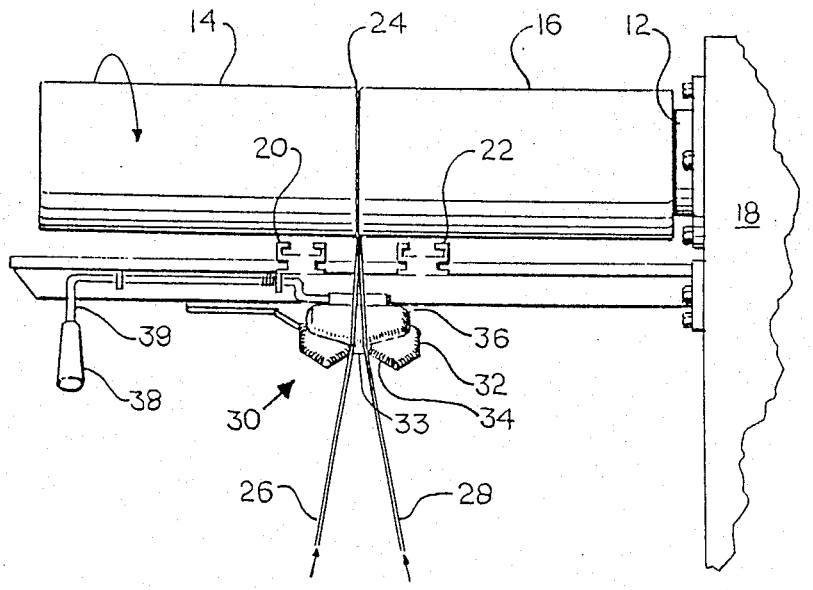
FIG. 1 is a diagrammatic illustration of a dual package winder utilizing the yarn transfer tail mechanism of the instant invention, the yarn transfer tail mechanism being in the first position.
Figure 2:
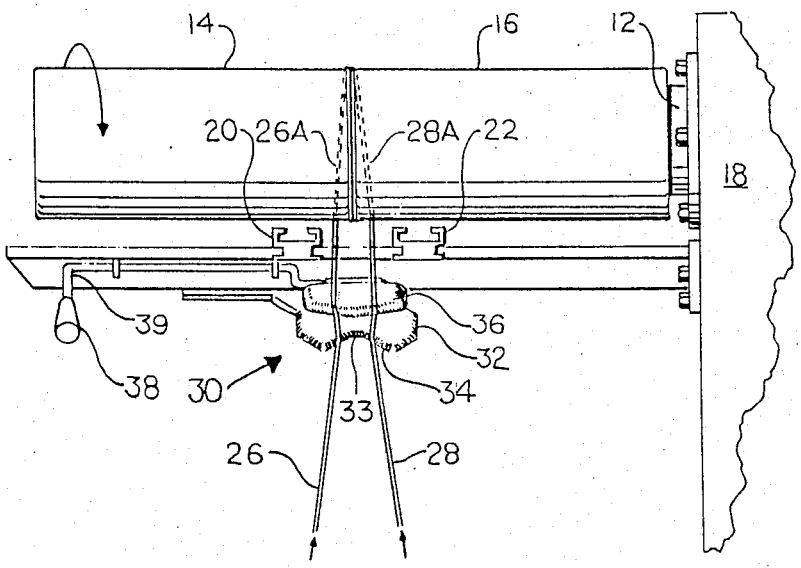
FIG. 2 is a diagrammatic illustration of the winder of FIG. 1 with the yarn strands being forced apart from each other by the movable upper portion of the transfer tail mechanism which has moved partially forwardly and upwardly from the first position behind the yarn guide surface of the fixed yarn guide element towards the second position wherein at least the front portion thereof extends beyond the yarn guide surface.
Figure 3:
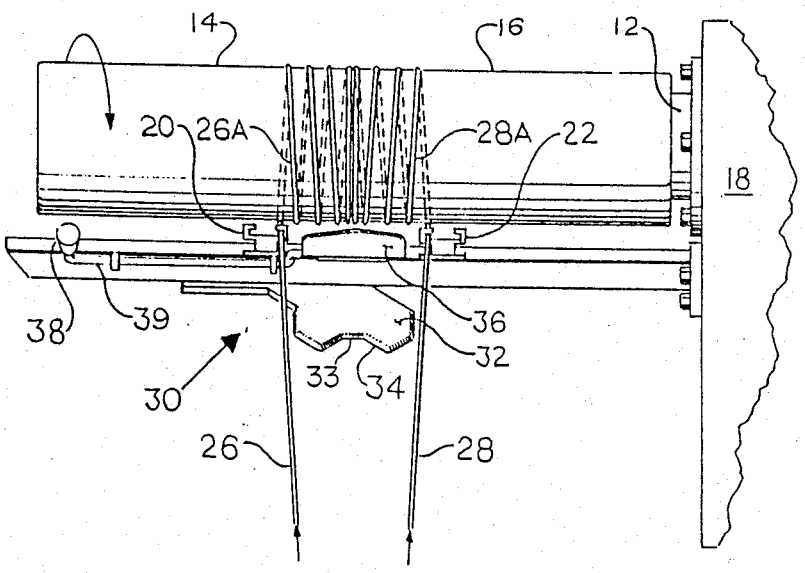
FIG. 3 is a diagrammatic illustration of the winder with the movable yarn guide element of the transfer tail forming mechanism in its forwardmost position wherein the yarn strands have been forced from the yarn guide surface of the fixed yarn guide element into engagement with the reciprocating transverse guides.

Referring now to FIGS. 1, 2 and 3, there are shown diagrammatic illustrations of the transfer tail forming mechanism of the invention illustrating how it serves to form yarn transfer tails at the abutting ends of two yarn tubes.

The high-speed, two cop take-up winder comprises a rotatable spindle 12 onto which two winding tubes 14 and 16 are slidably positioned in abutting relationship. Spindle 12 is driven by a motor (not shown) associated with housing 18. A second motor (not shown) serves to motivate reciprocating transverse guides 20 and 22 such that transverse guide 20 serves to build a yarn package on tube 14 and transverse guide 22 serves to build a package on tube 16. A slot 24 is located between the abutting ends of winding tubes 14 and 16, and its function in assisting in the forming of transfer tails will be explained more fully hereinafter. Yarn strands 26 and 28 are each fed from a respective source and through the yarn transfer tail mechanism of the invention, generally designated 30, and placed in the nip between abutting winding tubes 14 and 16 in order to form yarn packages with transfer tails on winding tubes 14 and 16. It will be appreciated that the winding machine and the source of yarn strands 26 and 28 are conventional and therefore further detailed description thereof are not required in order to fully appreciate the novel transfer tail formation device 30 disclosed herein.

Transfer tail formation device 30 comprises a fixed yarn guide element 32 which is secured to the winding machine in a suitable fashion (not shown). Fixed yarn guide element 32 defines an outwardly facing yarn guide surface 34 with the medial portion thereof having two diverging sides which are joined at the rear of the guide surface by a web 33 or laterally extending back edge or side (see FIG. 4A). A movable yarn guide element 36 having a V-shaped front portion is provided to work in association with fixed yarn guide element 32 in order to form a yarn transfer tail for each package of yarn wound onto winding tubes 14 and 16. Movable yarn guide element 36 is adapted to pivot from a first position where the V-shaped front portion of the movable yarn guide element is behind the web of yarn guide surface 34 and behind web 33 of fixed yarn guide element 32 to a second position where at least a portion of the V-shaped front portion or edge of movable yarn guide element 36 extends beyond yarn guide surface 34 and in front of web 33. The movement of movable yarn guide element 36 from the first to the second position serves to aid in the proper and controlled formation of yarn transfer tails in a fashion which will be more fully explained hereinafter. It should be appreciated that the forward movement by yarn guide element 36 from the first to the second position can be accomplished in various ways including pivotal movement or sliding movement relative to fixed yarn guide element 32.

Although a handle 38 and arm 39 are shown as a manual means by which movable yarn guide element 36 may be actuated, it is also contemplated that automatic means (not shown) may be utilized. The choice of manual versus automatic actuation means for transfer tail formation device 30 is a matter of design and user choice. Regardless of which actuation means is utilized, the transfer tail formation device 30 provides a simple device which allows for the formation of a selected number of spiral transfer tail wraps around each of winding tubes 14 and 16.

Figure 4C:
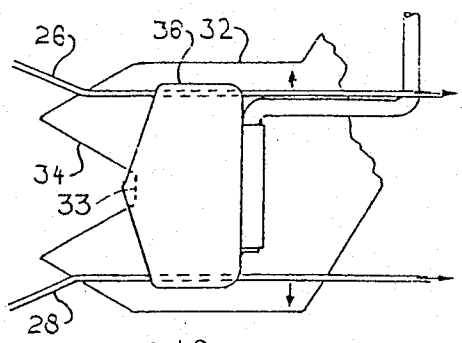
FIGS. 4A–4C and FIGS. 4AA–4CC are top plan schematic views and side elevation views, respectively, of the transfer tail forming mechanism as the movable yarn guide element moves forwardly through a pivotal arc motion from the first inoperative position to the second position.
Figure 4B:
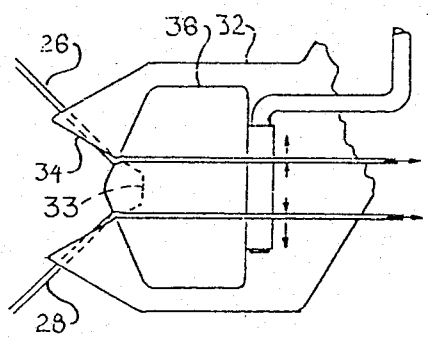
Figure 4A:
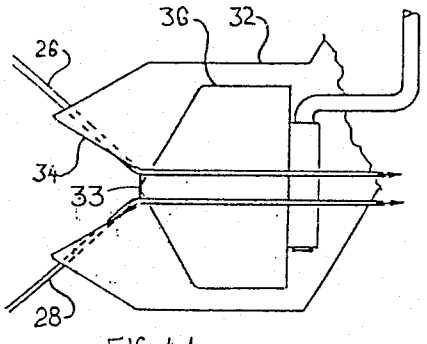
Figure 4C:
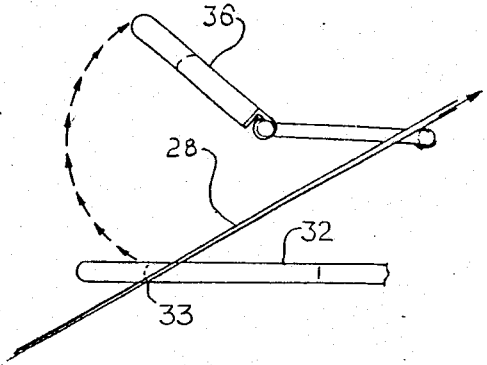
Figure 4B:
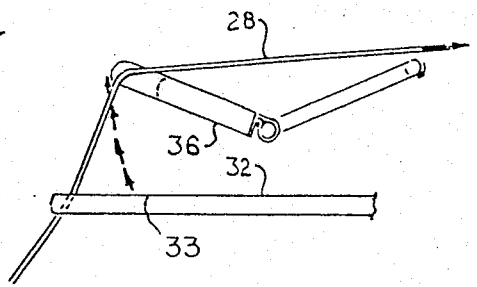
Figure 4A:
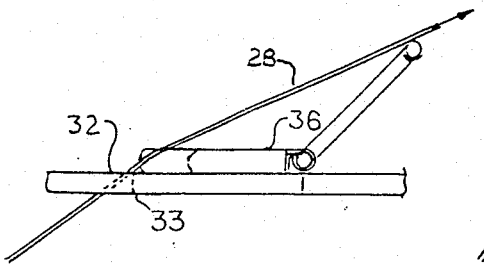

In order to more fully describe transfer tail formation device 30, the operational sequence for its use will now be described. Initially, yarn strands 26 and 28 are taken from their respective sources and placed into yarn guide surface 34 of transfer tail formation device 30 prior to being passed under rotating winding tubes 14 and 16 and secured in slot 24 formed at the abutting ends thereof. FIG. 1 and FIGS. 4A, 4AA depict this point at the beginning of the transfer tail formation sequence. Yarn strands 26 and 28 tend to quickly separate to the two opposite ends of the back web or side of guide surface 34 (see FIG. 4A) since they are under lateral tension due to the location of each strand's respective spaced-apart guide arms and wheels. Although other configurations are possible, the preferred width at the mouth of yarn guide surface 34 is about $\frac{7}{8}$ inch with a back web width of about $\frac{3}{8}$ inch. As will be recognized by one skilled in the art, other dimensions may be utilized as a matter of design choice.

Rotating spindle 12 rotates winding tubes 14 and 16, and preferably about one to eight wraps of yarn strands 26 and 28 should be initially placed around slot 24 defined by the abutting ends of winding tubes 14 and 16. This wrapping action serves to establish tension on each of the yarn strands and to fully separate yarn strands 26 and 28 into their respective locations at opposing ends of the web at the back of yarn guide surface 34. Next, movable yarn guide element 36, which is V-shaped and preferably defines the form of a spade, is actuated by handle 38 so as to begin to travel forward and upward from its rearwardmost position depicted in FIG. 4A. As movable yarn guide element 36 moves forwardly and upwardly, as best seen in FIGS. 2 and 4B, 4BB, it serves to force each of yarn strands 26 and 28 outwardly along a respective diverging side of guide surface 34. It can be appreciated that this movement of yarn strands 26 and 28 translates into lateral motion of the yarn strands inwardly toward the medial portion of winding tubes 14 and 16, respectively, as best seen in FIG. 2. In this fashion, precise control can be exercised in the formation of spiral winds of yarn strands 26 and 28 onto winding tubes 14 and 16, respectively, to form yarn transfer tails. Thus, by controlling the speed of forward movement of movable yarn guide element 36 in relation to the rotational speed of spindle 12, a preselected portion or number of spiral wraps **26*a*, 28*a* (see FIG. 3) can be formed on winding tubes 14 and 16** in order to form transfer tails of a desired length.

Finally, movable yarn guide element 36 reaches its forwardmost second position (see FIGS. 4C, 4CC) wherein the leading edge thereof forces yarn strands 26 and 28 out of guide surface 34. When this occurs, yarn strands 26 and 28 are urged laterally apart and inwardly toward winding tubes 14 and 16 by the aforementioned tension thereon and into the path of a respective reciprocating transverse guide 20, 22. When yarn strands 26 and 28 are engaged by reciprocating transverse guides 20 and 22, respectively, the main body of the yarn package is formed on the winding tubes (see FIG. 3).

It will thus be seen that there has been described above an apparatus and method for the formation of yarn transfer tails which allows for precise and controllable creation of transfer tails and obviates problems experienced heretofore known to those experienced in this art.

It will be understood that various details of the invention may be changed without departing from the scope of the invention. Furthermore, the foregoing description is for purpose of illustration only and not for the purpose of limitation—the invention being defined by the claims.

What is claimed is:

1. An apparatus for simultaneously winding yarn on multiple winding tubes comprising:

means for rotatably mounting at least two abutting winding tubes;

means for rotating said winding tubes;

means for feeding at least one yarn strand to each of said winding tubes;

reciprocating guide means associated with said mounting means for guiding said yarn strands across said winding tubes to build yarn packages on said winding tubes; and transfer tail forming means positioned adjacent said reciprocating guide means and comprising:

a fixed yarn guide element for initially engaging said yarn strands and having a yarn guide surface therein with diverging sides extending generally outwardly and defining an opening between the outer ends thereof, said diverging sides continuously diverging along the entire yarn engaging length thereof and said diverging sides being joined at the rear of the guide surface by a web;

a pivotably movable yarn guide element cooperatively associated with said fixed yarn guide element, said pivotably movable yarn guide element having a V-shaped front portion and being adapted to pivot from a first position wherein the V-shaped front portion of the movable yarn guide element is behind the web of said yarn guide surface to a second position wherein at least part of said V-shaped front portion is spaced apart from and in front of said yarn guide surface of said fixed yarn guide element; and means for pivoting said pivotably movable yarn guide element from said first to said second position;

whereby during the course of movement from said first to said second position said movable yarn guide element urges at least one yarn strand outwardly along each diverging side of said yarn guide surface so as to helically wind a transfer tail onto each of said winding tubes.

2. An apparatus according to claim 1 wherein said fixed yarn guide element comprises a substantially W shape wherein the medial portion thereof comprises said yarn guide surface.

* * * * *